US009208926B2

(12) United States Patent
Chartier

(10) Patent No.: US 9,208,926 B2
(45) Date of Patent: Dec. 8, 2015

(54) ACTIVE COOLING OF MEDIUM VOLTAGE POWER UMBILICALS

(71) Applicant: Oceaneering International, Inc., Houston, TX (US)

(72) Inventor: Andre Joseph Chartier, Houston, TX (US)

(73) Assignee: Oceaneering International, Inc., Houston, TX (US)

( * ) Notice: Subject to any disclaimer, the term of this patent is extended or adjusted under 35 U.S.C. 154(b) by 0 days.

(21) Appl. No.: 13/683,786

(22) Filed: Nov. 21, 2012

(65) Prior Publication Data

US 2014/0060873 A1 Mar. 6, 2014

Related U.S. Application Data

(60) Provisional application No. 61/697,727, filed on Sep. 6, 2012.

(51) Int. Cl.
*H01B 7/14* (2006.01)
*H01B 7/42* (2006.01)
*H01B 7/04* (2006.01)

(52) U.S. Cl.
CPC ..... *H01B 7/423* (2013.01); *H01B 7/045* (2013.01); *H01B 7/14* (2013.01)

(58) Field of Classification Search
USPC ..... 174/15.1, 26 R, 47; 361/679.47, 679.46, 361/679.49
See application file for complete search history.

(56) References Cited

U.S. PATENT DOCUMENTS

| | | | | |
|---|---|---|---|---|
| 3,517,110 | A * | 6/1970 | Morgan | E21B 17/012 114/230.13 |
| 6,046,404 | A | 4/2000 | Figenschou et al. | |
| 2011/0005795 | A1 | 1/2011 | Deighton et al. | |
| 2011/0176273 | A1 * | 7/2011 | Olsen | G06F 1/20 361/679.47 |

* cited by examiner

*Primary Examiner* — Tremesha S Willis
*Assistant Examiner* — Michael E Moats, Jr.
(74) *Attorney, Agent, or Firm* — Maze IP Law, PC

(57) ABSTRACT

An umbilical comprises an outer sheath defining an interior void; one or more power cores; and one or more forced convection cooling circuits disposed within the interior void proximate the power cores, typically at least one forced convection cooling circuit paired with each power core. The forced convection cooling circuit comprises a heat exchange delivery fluid conduit and a heat exchange return fluid conduit in fluid communication with the heat exchange delivery fluid conduit, where at least one of the fluid conduits is disposed either proximate to the other conduit or disposed within the other conduit. The forced convection cooling circuit has a length which has been determined to be sufficient to achieve a desired heat exchange that results in a desired efficient evacuation of heat energy from the power cores along a predetermined length of the umbilical.

9 Claims, 3 Drawing Sheets

ACTIVE COOLING OF MEDIUM VOLTAGE POWER UMBILICALS

RELATION TO OTHER APPLICATIONS

This application relates to and claims the benefit of U.S. Provisional Application 61/697,727 filed on Sep. 6, 2012.

BACKGROUND

The increased use of subsea systems that require large levels of electrical power used to support the functionality of subsea equipment of various types requires the incorporation of large diameter electrical conductors within subsea umbilicals. These conductors invariably dominate the design and manufacturing processes of the umbilical in which they are required and as a result the total fabricated cost of these functional elements invariably dominates the economics of this type of umbilical assembly.

The electrical performance of these types of umbilicals is significantly influenced by the overall operating temperature of the umbilical as this impacts the resistance of these medium voltage conductors and this in turn affects the electrical losses in the cables.

Although these umbilicals are typically many kilometers long, the majority of which operating in a subsea environment surrounded by seawater that keeps the cable operating at relatively cool temperatures, their design is frequently limited by a very short length that is either located in an I-tube located on the side of a floating production storage and offloading vessel (FPSO) or in a large dynamic bend strain reliever (BSR) that is used to protect the power umbilical from being over-bent at the mechanical connection with the FPSO. In cases where the power umbilical is routed through a I-Tube that is located on the side of the FPSO, its operating temperature will be further impacted by the level of solar radiation acting on the external surfaces of the I-tube and the overall ambient temperature.

The design of medium voltage power cable systems are frequently dominated by the operating temperature of a very short section of the overall length of the system leading the use of larger conductors than would otherwise be needed or the use of higher transmission voltages and subsea transformers. In the past, people have used larger, more expensive conductors and/or an expensive transformer.

The various embodiments described herein lower the operating temperature of a short length of an umbilical that previously dominated the system design such that its operating temperature is no longer as much of a factor in the overall system design. In typical designs, the maximum operating temperatures cannot exceed 90° C. One method by which this has been accomplished is to increase the cross-sectional area of the conductors in the umbilical, thereby reducing their electrical resistance. This adds significantly to project costs and in many cases results in additional complications associated with the need to splice conductors during the assembly of the umbilical.

DESCRIPTION OF THE DRAWINGS

The figures supplied herein disclose various embodiments of the claimed invention.

DESCRIPTION OF EMBODIMENTS

Figure 1:
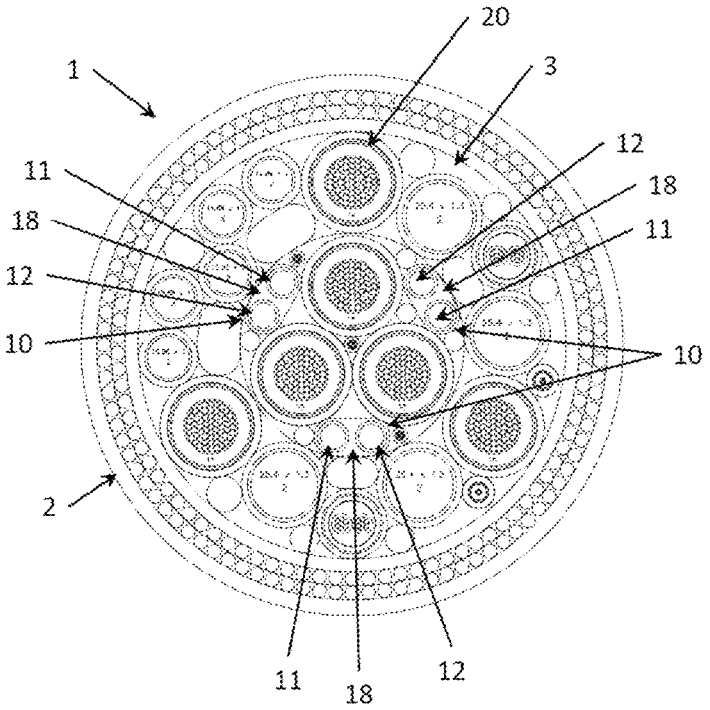
FIG. 1 is an illustration of a cross-section of a first embodiment of the invention.

Referring generally to FIG. 1, an advantage of the embodiments of the invention described herein is that cooling circuits may be placed in a topside portion of umbilical 1 and enable smaller power conductors to be used for the supply of the required level of power for the subsea system. In many cases this will allow subsea electrical systems to avoid the use of expensive subsea transformers and high voltage connectors significantly improving the project economics.

Referring still to FIG. 1, umbilical 1 comprises outer sheath 2 defining an interior void 3; one or more power cores 20 disposed within interior void 3; and one or more forced convection cooling circuit 10 disposed within interior void 3 proximate one more power cores 20. In typical embodiments, there is one forced convection cooling circuit 10 for each power core 20, each forced convection cooling circuit 10 typically disposed at location within interior void 3 as close as possible to its respective power core 20 at a distance that provides an efficient evacuation of heat energy from power core 20 to aid in maximizing an electrical power transfer capacity of power core 20 within a predetermined operating temperature range.

Figure 2:
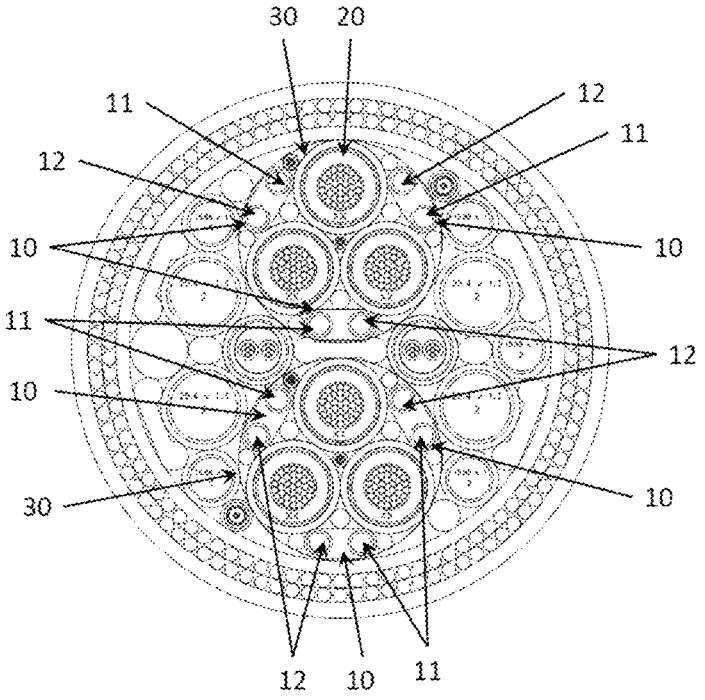
FIG. 2 is an illustration of a cross-section of a second embodiment of the invention.

As generally illustrated in FIG. 1 and FIG. 2, power cores 20 may be arranged in various ways where at least one power core 20 is paired with one or more forced convection cooling circuits 10.

Figure 3:
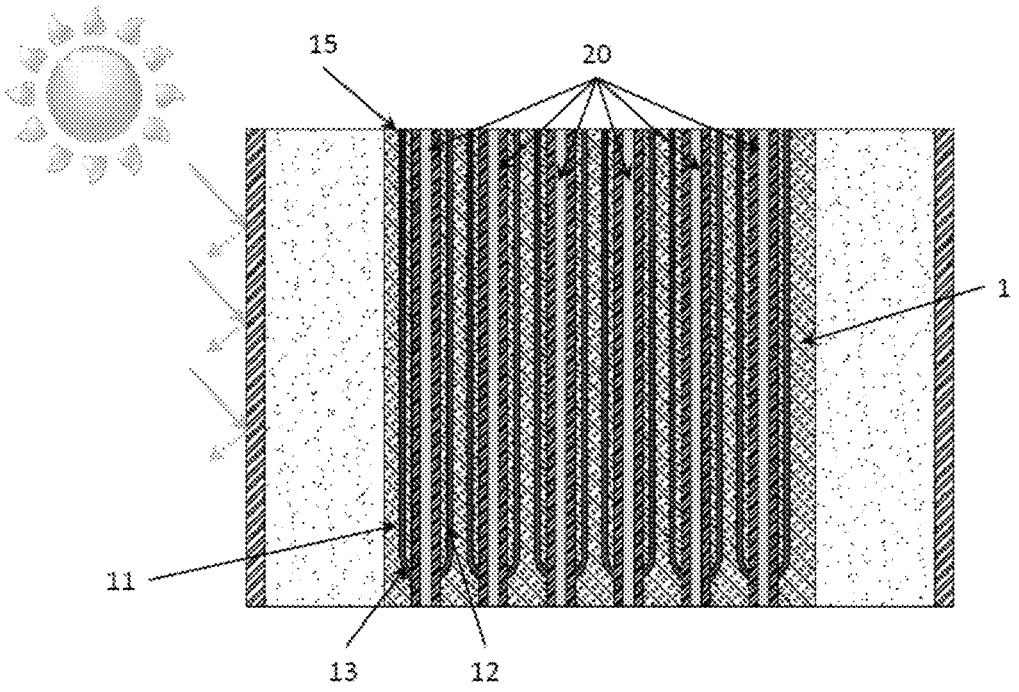
FIG. 3 is a diagrammatic view of a closed-loop embodiment of the invention.
Figure 4:
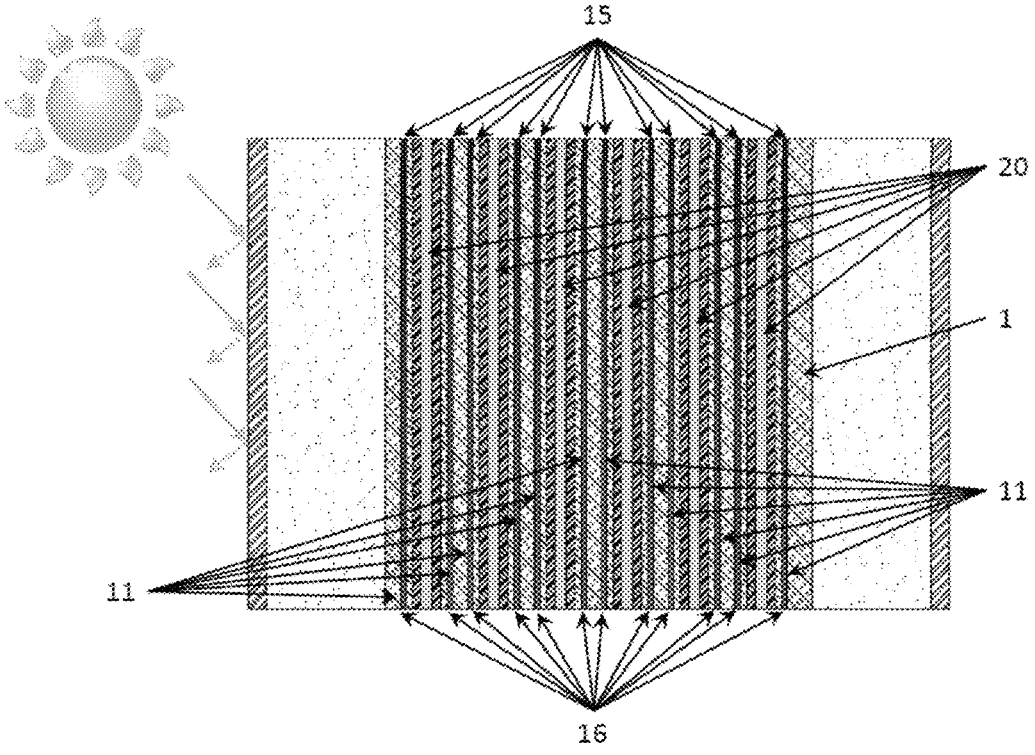
FIG. 4 is a diagrammatic view of an open-loop embodiment of the invention.

Referring additionally to FIG. 3 and FIG. 4, forced convection cooling circuit 10 may be configured as a closed loop (FIG. 3) system or as an open loop (FIG. 4) system.

Forced convection cooling circuit 10 comprises one or more heat exchange delivery fluid conduits 11 and one or more heat exchange return fluid conduits 12 arranged in pairs, i.e. a heat exchange delivery fluid conduit 11 in fluid communication is paired with a corresponding heat exchange delivery fluid conduit 12.

In certain embodiments, forced convection cooling circuit external conduit 18 extends around each heat exchange delivery fluid conduit 11 and heat exchange return fluid conduit 12 pairs. Typically, forced convection cooling circuit external conduit 18 comprises plastic coating adapted to allow convenient handling of the heat exchange delivery fluid conduit 11 and heat exchange return fluid conduit 12 pair as a subassembly. Moreover, it is advantageous to use a plastic or other suitable material that shields external surfaces of heat exchange delivery fluid conduit 11 and heat exchange return fluid conduit 12 from corrosive seawater to protect these conduits, as the corrosive nature of seawater is typically exaggerated by the elevated operating temperature of power cores 20.

In certain embodiments, heat exchange delivery fluid conduit 11 and heat exchange return fluid conduit 12 comprise loop juncture 13 (FIG. 3) at a predetermined length of umbilical 1, where loop juncture 13 is dimensioned to allow fluid to pass between heat exchange delivery fluid conduit 11 and heat exchange return fluid conduit 12. The predetermined length is typically at a location sufficiently removed from an elevated temperature region of umbilical 1 such that an additional length of forced convection cooling circuit 10 provides no further operational heat exchange benefit.

Forced convection cooling circuit 10 is typically configured to accept fluid cooling fluid 40 (FIG. 5), which can be fresh water, filtered seawater, a fluid that is already being delivered as an existing hydraulic function within the umbilical 1, or the like, or a combination thereof. In closed loop embodiments, fluid cooling fluid 40 may be introduced into forced convection cooling circuit 10 which is then sealed.

In some configurations, such as an open loop system (FIG. 4), forced convection cooling circuit 10 further comprises inlet 15 dimensioned and adapted to receive a suitable cooling fluid where inlet 15 is in fluid communication with heat exchange delivery fluid conduit 11. Inlet 15 is typically located at a topside mechanical termination of umbilical 1. In alternative embodiments, forced convection cooling circuit 10 may comprise inlet 15 and outlet 16 (FIG. 4) which is configured to vent cooling fluid 40 (FIG. 5) into a body of water at a location along a length of umbilical 1 beyond which additional cooling is not required. In this configuration, cooling fluid 40 may comprise an environmentally suitable fluid. In certain of these configurations, the pairs of conduit comprise heat exchange delivery fluid conduits 11.

Figure 5:
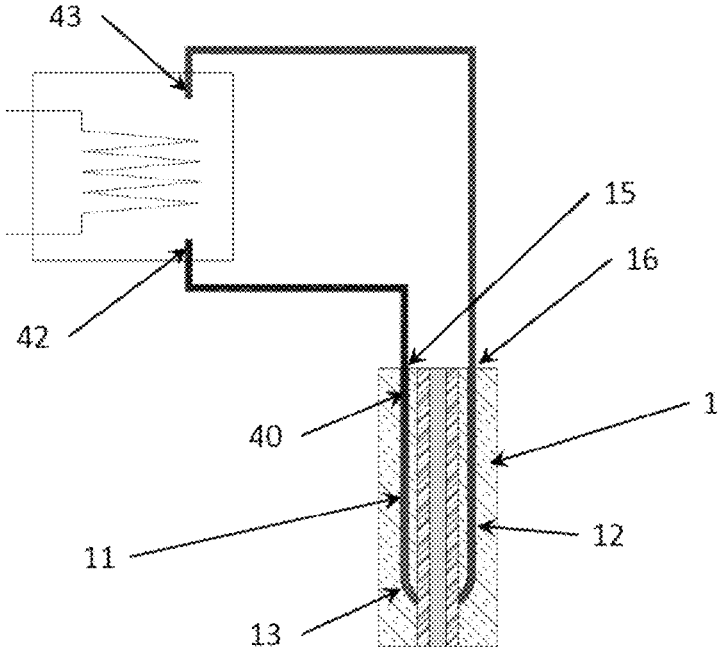
FIG. 5 is a diagrammatic view of a open-loop embodiment of the invention.

Referring additionally to FIG. 5, in configurations with inlet 15, source of cooling fluid 42 may be present and in fluid communication with inlet 15. For these configurations, source of cooling fluid 42 may further comprise dedicated refrigerant supply and return system 43 where dedicated refrigerant supply and return system 43 is configured to provide fluid cooling fluid 40 that comprises a refrigerant.

Figure 6:
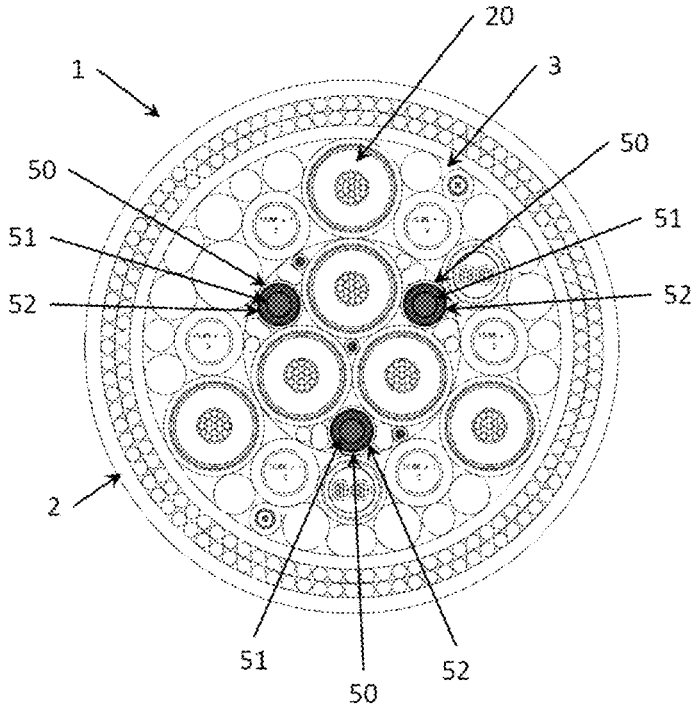
FIG. 6 is an illustration of a cross-section of a third embodiment of the invention.

Referring to FIG. 6, in a further alternative embodiment, umbilical 1 comprises outer sheath 2 defining interior void 3; one or more power cores 20; and one or more forced convection cooling circuits 50 disposed within interior void 3 proximate power cores 20. In typical embodiments of this alternative, there is one forced convection cooling circuit 50 for each power core 20, each forced convection cooling circuit 50 typically disposed at location within interior void 3 as close as possible to its respective power core 20 at a distance that provides an efficient evacuation of heat energy from power core 20 to aid in maximizing an electrical power transfer capacity of power core 20 within a predetermined operating temperature range.

Forced convection cooling circuit 50 comprises first fluid conduit 51 comprising first diameter 53 (not shown in the figures) and second fluid conduit 52 in fluid communication with first fluid conduit 51, second fluid conduit 52 having second diameter 55 (not shown in the figures) smaller than first diameter 53. In these embodiments, second fluid conduit 52 is disposed partially or totally within first fluid conduit 51. In certain embodiments, first fluid conduit 51 comprises or otherwise defines an exchange return fluid conduit and second fluid conduit 52 comprises or otherwise a heat exchange delivery fluid conduit.

In the operation of preferred embodiments, referring generally to FIG. 1 and FIG. 6, to achieve the desired heat removal from umbilical 1, umbilical 1 is provided, which comprises outer sheath 2 defining interior void 3 and one or more power cores 20. Umbilical 1 comprises one or more forced convection cooling circuits 10 or 50, described above, which may be fabricated as a pre-fabricated sub-assembly and pulled in a parallel arrangement through an extrusion process and encapsulated together to form a single element. Loop juncture 13 is incorporated within the assembly at the required length, detailed below. The completed forced convection cooling circuits 10 or 50 may then be introduced as a sub-assembly would into the larger assembly process of umbilical 1. In certain embodiments, forced convection cooling circuits 10 or 50 may be replaced in umbilical 1, e.g. in a cross-section, with simple polymeric fillers at the point in the length of umbilical 1 where forced convection cooling circuits 10 or 50 is no longer required.

The length of forced convection cooling circuits 10 or 50 is determined by determining a length of umbilical 1 along which a predetermined heat exchange is to be effected and a desired efficient evacuation of heat energy from power core is calculated or otherwise determined which will allow a desired characteristic of an electrical power transfer capacity of power core 20 to be achieved within a predetermined operating temperature range. The desired characteristic may comprise maximization of the electrical power transfer capacity of the power core within the predetermined operating temperature range.

A length of forced convection cooling circuit 10 or 50 is determined which will be sufficient to effect a desired heat exchange to achieve the desired efficient evacuation of heat energy from power core 50 along a predetermined length of the umbilical 1. This length of forced convection cooling circuit 10 or 50 may be determined by determining a location sufficiently removed from an elevated temperature region of umbilical 1 such that an additional length of forced convection cooling circuit 10 or 50 provides no further operational heat exchange benefit. The desired length of forced convection cooling circuit 10 or 50 is then disposed within interior void 3 proximate power core 20, where forced convection cooling circuit 10 and 50 are as described herein.

Cooling fluid 40 is introduced into forced convection cooling circuit 10 or 50, either before fabrication, during fabrication, or, in certain embodiments as described herein, during operation of, e.g., an open loop system. As noted above, cooling fluid may comprise fresh water, filtered seawater, a refrigerant, a fluid that is already being delivered as an existing hydraulic function within umbilical 1 as the fluid, or the like, or a combination thereof. As described above, cooling fluid 40 into forced convection cooling circuit 10 or 50 via inlet 15 and, in certain configurations, vented through outlet 16 into a body of water at a location along the umbilical 1 length beyond which additional cooling is not required, e.g. where cooling fluid 40 comprises an environmentally suitable fluid.

The foregoing disclosure and description of the inventions are illustrative and explanatory. Various changes in the size, shape, and materials, as well as in the details of the illustrative construction and/or an illustrative method may be made without departing from the spirit of the invention.

What is claimed is:

1. An umbilical, comprising:

a. an outer sheath disposed substantially about an entire length of an umbilical, the outer sheath defining an interior void;

b. a power core disposed within the interior void; and c. an open loop forced convection cooling circuit disposed within the interior void proximate the power core, the forced convection cooling circuit comprising:

i. a heat exchange delivery fluid conduit disposed proximate the power core within the sheath and configured to provide for evacuation of heat energy from the power core within a predetermined operating temperature range along a predetermined length of the power core within the sheath;

ii. a heat exchange return fluid conduit in fluid communication with the heat exchange delivery fluid conduit;

iii. an inlet configured to receive a cooling fluid, the inlet in fluid communication with the heat exchange delivery fluid conduit; and iv. an outlet configured to vent the cooling fluid into a body of water at a location along the umbilical length beyond which additional cooling is not required, the outlet in fluid communication with the heat exchange return fluid conduit.

2. The umbilical of claim 1, wherein the cooling fluid comprising at least one of fresh water, filtered seawater, or a fluid that is already being delivered as an existing hydraulic function within the umbilical.

3. The umbilical of claim 1, wherein the forced convection cooling circuit is disposed at location within the interior void as close as possible to the power core at a distance that provides an efficient evacuation of heat energy from the power core to aid in maximizing an electrical power transfer capacity of the power core within a predetermined operating temperature range.

4. The umbilical of claim 1, wherein the heat exchange delivery fluid conduit and the heat exchange return fluid conduit comprise a loop juncture at a predetermined length of the umbilical, the loop juncture dimensioned to allow fluid to pass between the heat exchange delivery fluid conduit and the heat exchange return fluid conduit.

5. The umbilical of claim 4, wherein the predetermined length is at a location sufficiently removed from an elevated temperature region of the umbilical such that an additional length of the forced convection cooling circuit provides no further operational heat exchange benefit.

6. The umbilical of claim 1, wherein the inlet is located at a topside mechanical termination of the umbilical.

7. The umbilical of claim 6, further comprising a source of cooling fluid in fluid communication with the inlet.

8. The umbilical of claim 7, wherein the source of cooling fluid is configured to provide a fluid cooling fluid comprising at least one of fresh water, filtered seawater, or a fluid that is already being delivered as an existing hydraulic function within the umbilical.

9. The umbilical of claim 8, wherein:

a. the source of cooling fluid comprises a dedicated refrigerant supply and return system; and b. the dedicated refrigerant supply and return system is configured to provide a fluid cooling fluid that comprises a refrigerant.

* * * * *